US007305980B2

(12) United States Patent
Liao

(10) Patent No.: US 7,305,980 B2
(45) Date of Patent: Dec. 11, 2007

(54) GEAR BOX STRUCTURE FOR A TOY GUN

(75) Inventor: Yin-Hsi Liao, Sijhih (TW)

(73) Assignee: Guay Guay Trading Co., Ltd., Sijhih (TW)

( * ) Notice: Subject to any disclaimer, the term of this patent is extended or adjusted under 35 U.S.C. 154(b) by 120 days.

(21) Appl. No.: 11/344,171

(22) Filed: Feb. 1, 2006

(65) Prior Publication Data

US 2007/0178806 A1 Aug. 2, 2007

(51) Int. Cl.
*F41B 7/08* (2006.01)

(52) U.S. Cl. ..... 124/31

(58) Field of Classification Search ..... 42/54, 42/58, 69.01, 69.02; 124/16, 17, 27, 28, 124/31, 73, 74, 76
See application file for complete search history.

(56) References Cited

U.S. PATENT DOCUMENTS 2,609,468 A * 9/1952 Gubbins ..... 173/217
2,830,570 A * 4/1958 Horowitz et al. ..... 124/52
3,696,706 A * 10/1972 Seidel et al. ..... 89/196
4,416,078 A * 11/1983 Hillberg ..... 42/69.01
4,910,903 A * 3/1990 Senfter ..... 42/69.02
5,722,193 A * 3/1998 Post ..... 42/51
6,439,217 B1 * 8/2002 Shih ..... 124/77

* cited by examiner

*Primary Examiner*—John A. Ricci
(74) *Attorney, Agent, or Firm*—Troxell Law Office, PLLC

(57) ABSTRACT

A gear box structure for a toy gun includes a box, a trigger assembly, an elastic member, a push plate, and a stop piece. The push plate is provided with a stop end which is interfered with a stop strip installed on the stop piece, so as to create a resistant force between the push plate and the stop piece. When pulling the trigger, the trigger assembly will drive the elastic member to slide the stop end of push plate over the stop strip of stop piece, thereby forming a tightness and looseness feeling as if pulling a trigger of real gun.

2 Claims, 6 Drawing Sheets

GEAR BOX STRUCTURE FOR A TOY GUN

BACKGROUND OF THE INVENTION (a) Field of the Invention

The present invention relates to a gear box structure for a toy gun, and more particularly to an improved structure of a gear box for a toy gun.

(b) Description of the Prior Art

It is well known that a toy guan has been an object that can be seen anywhere; the toy gun is displayed and sold in a department store, in a shop, and on a web site. However, although the ordinary toy gun has an appearance of genuine gun, it does not provide a feeling of pulling a trigger of real gun, during playing with the toy gun.

Furthermore, a current virtual-reality field shooting exercise has been one of the popular recreation activities, wherein players are pursuing a feeling as if shooting with a real gun, thereby enabling a pulling of a trigger to become one of the indispensable factors.

Accordingly, how to solve the aforementioned problems is a technical issue to be resolved by the inventor of present invention.

SUMMARY OF THE INVENTION

The present invention is to provide an improved structure of gear box for a toy gun wherein a resistant force is formed between a push plate and a stop piece by an interference of a stop strip and a stop end, such that a tightness and looseness feeling as if pulling a trigger of real gun is formed, upon pulling the trigger to slide the push plate over the stop piece.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
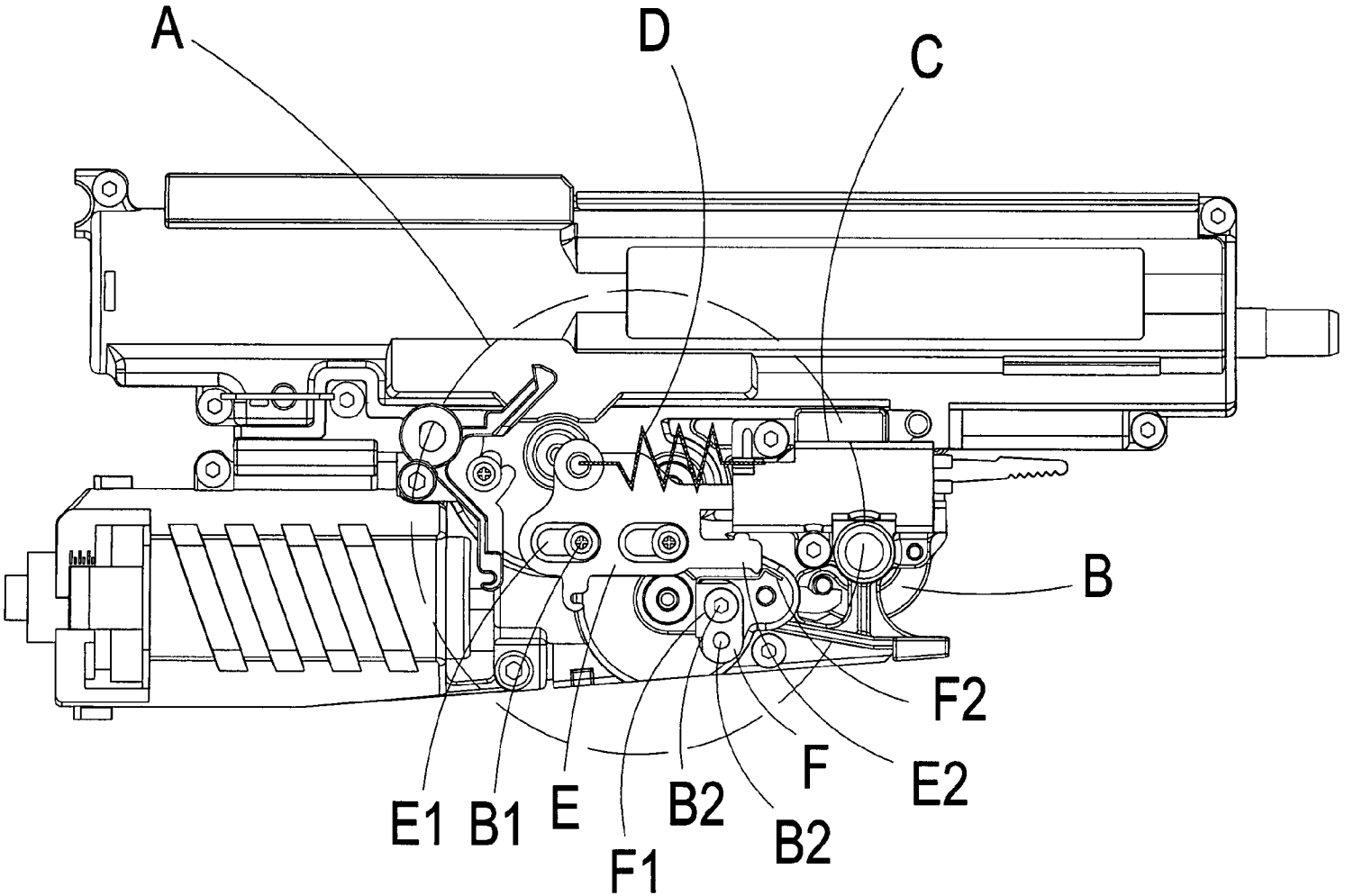
FIG. 1 shows a perspective view of the present invention.
Figure 1A:
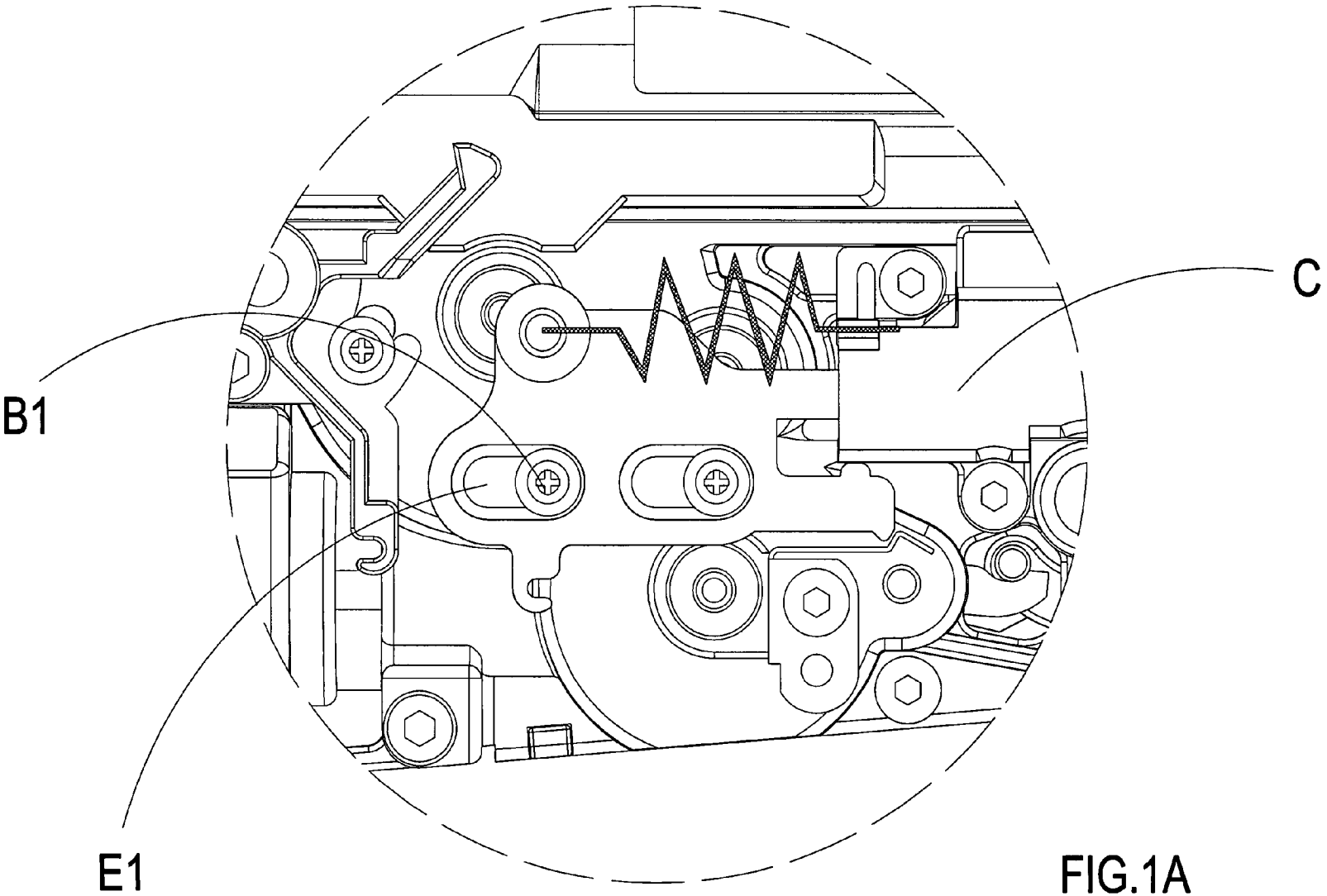
FIG. 1A shows a partial enlarged view of FIG. 1.
Figure 2:
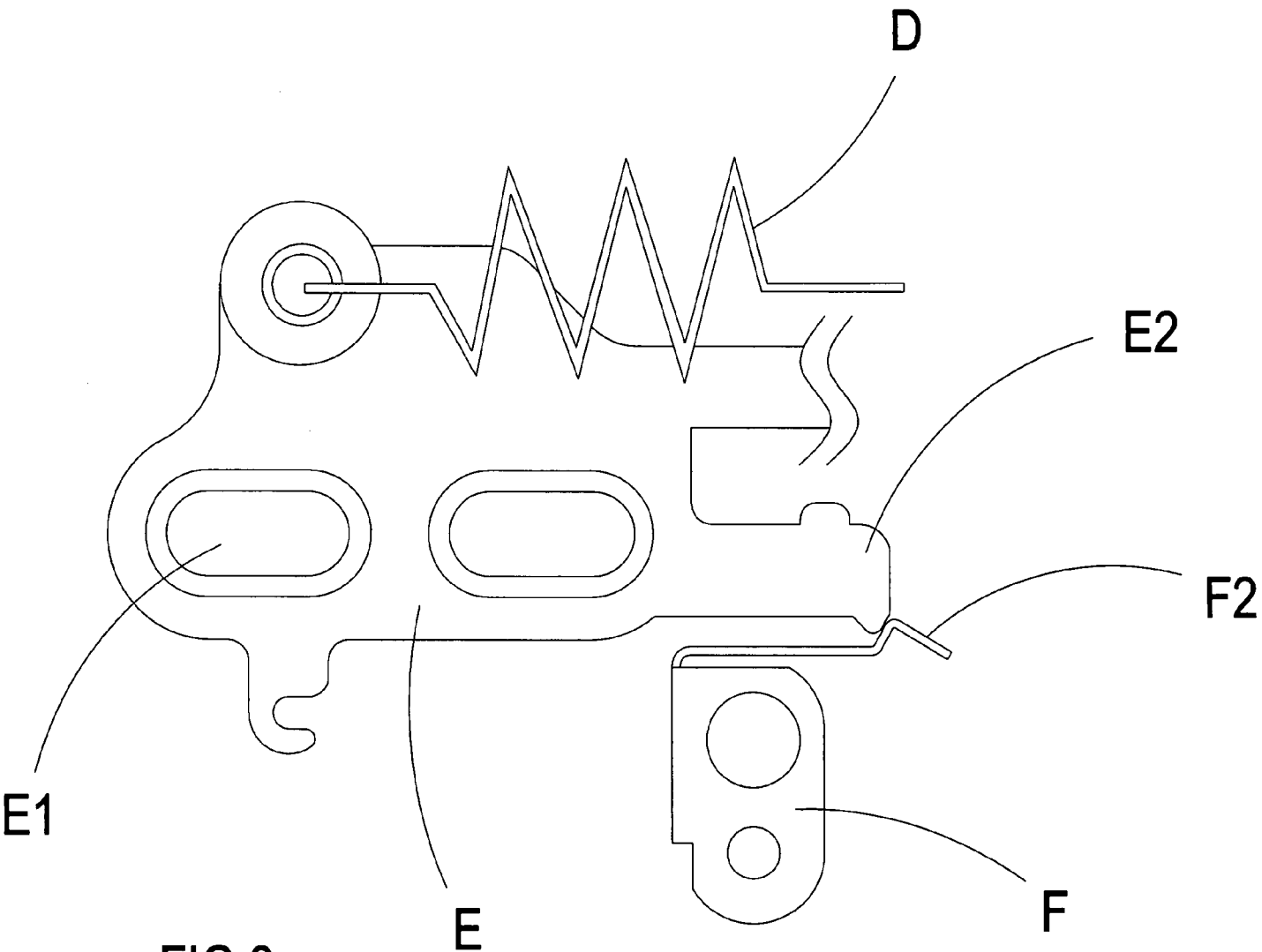
FIG. 2 shows a schematic view of actions of the present invention.
Figure 3:
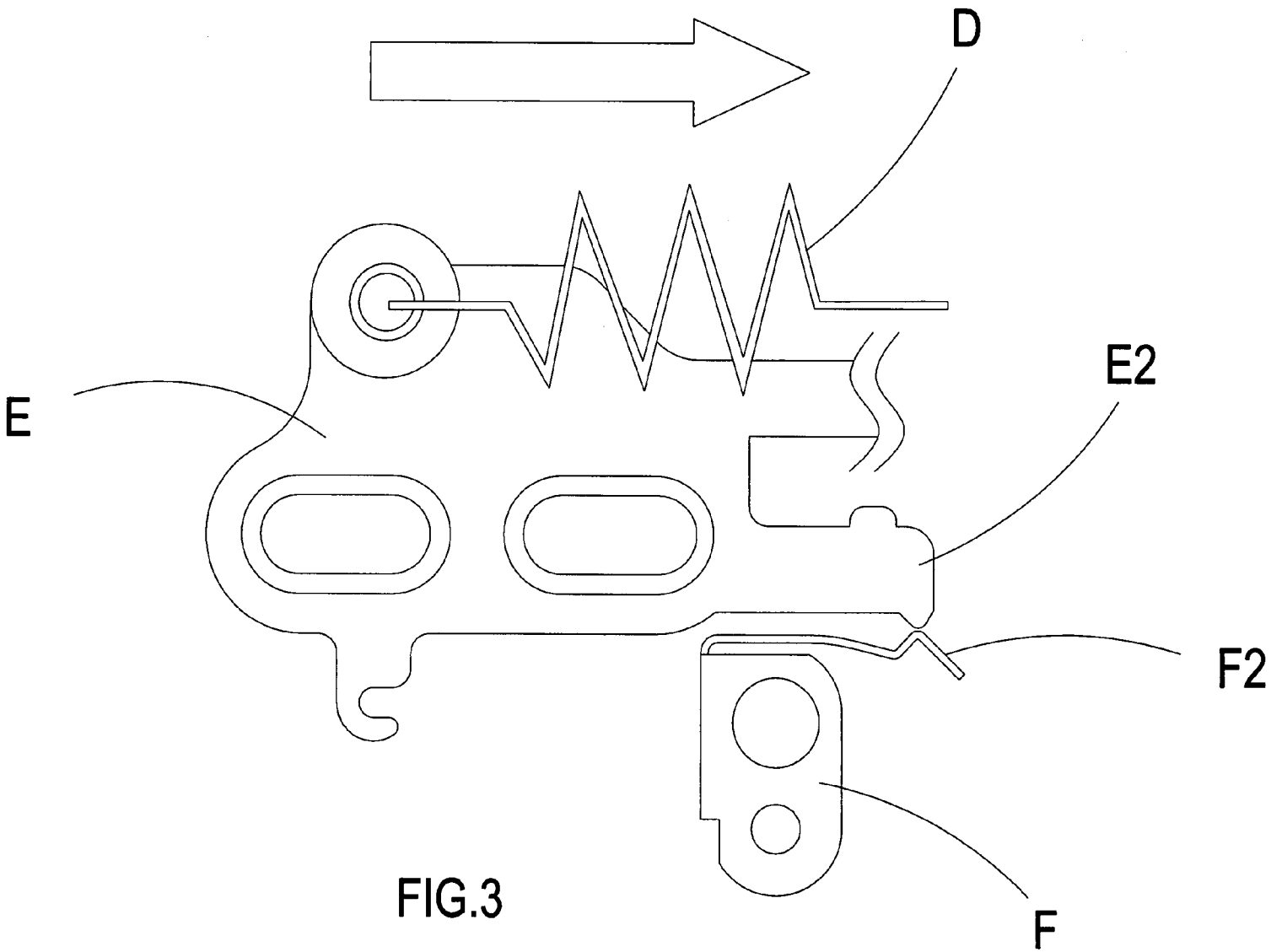
FIG. 3 shows a second schematic view of actions of the present invention.
Figure 4:
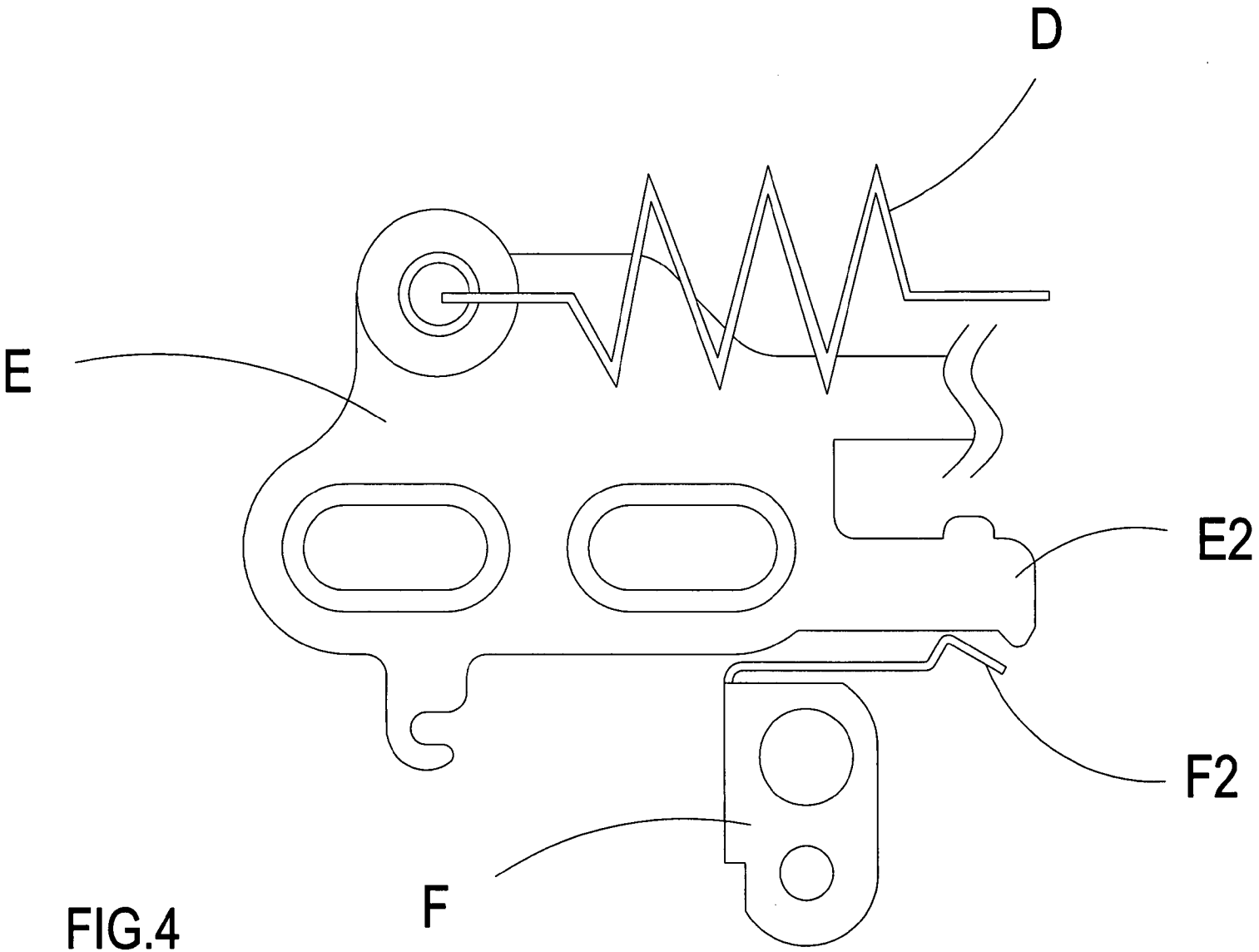
FIG. 4 shows a third schematic view of actions of the present invention.
Figure 5:
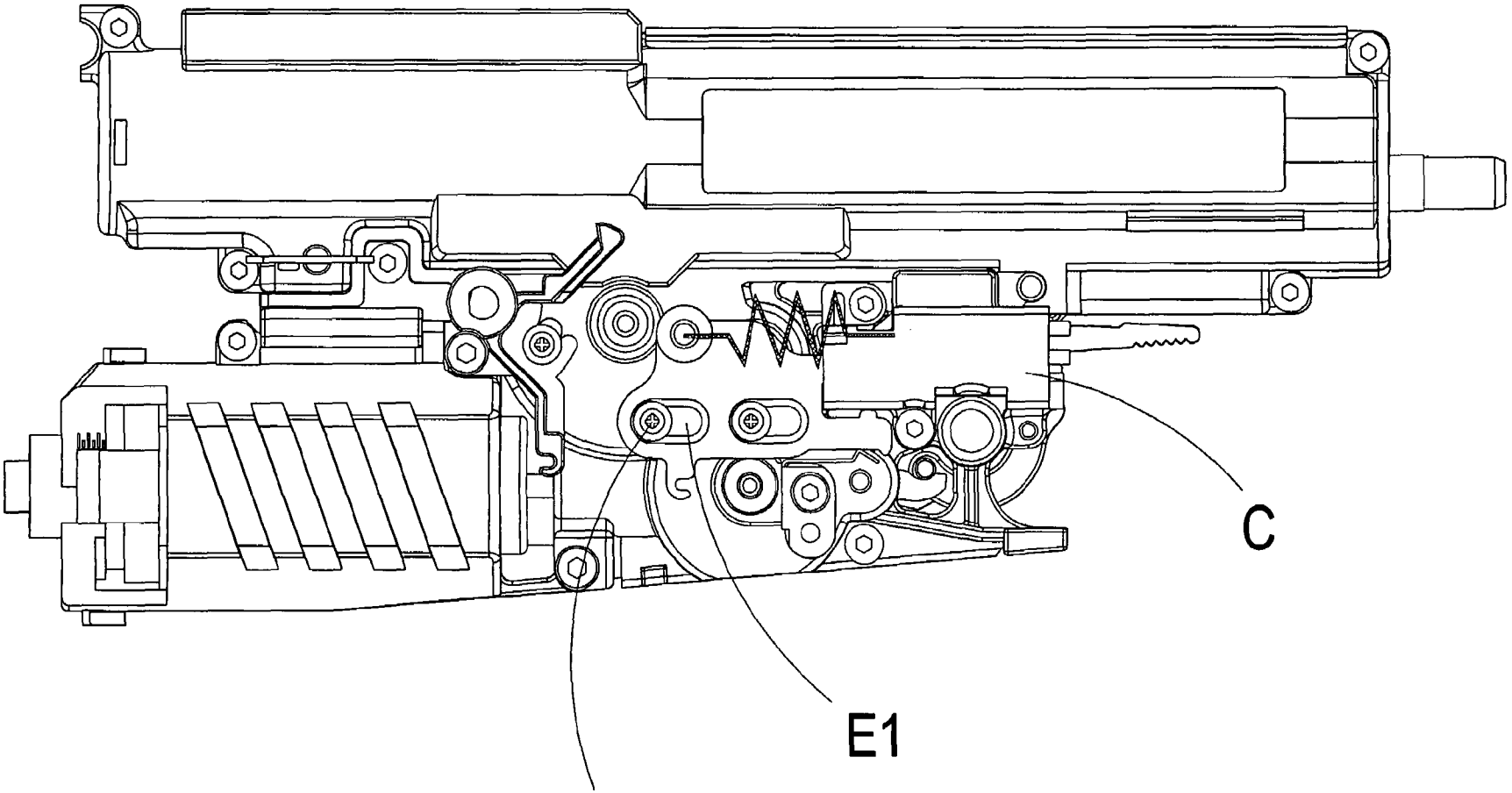
FIG. 5 shows a fourth schematic view of actions of the present invention.

The present invention is to provide an improved structure of gear for a toy gun. Referring to FIG. 1, a gear box A is composed of a box B, a trigger assembly C, an elastic member D, a push plate E, and a stop piece F, wherein the box B is provided with the trigger assembly C which is connected to an end of the elastic member D, the push plate E is connected to the other end of the elastic member D, and the stop piece F is located next to the push plate E.

The box B is installed with a plurality of shaft rods B1 and fixing rods B2. The shaft rod B1 is connected with a plurality of sliding holes E1 on the push plate E, such that the shaft rod B1 can be sliding in the sliding hole E1. The fixing rod B2 is assembled with a fixing hole F1 on the stop piece F, and the push plate E is installed with a stop end E2 which is interfered with a stop strip F2 on the stop piece F, so as to form a resistant force between the push plate E and the stop piece F.

Referring to FIGS. 1A to 5, when pulling the trigger, the trigger assembly C will drive the elastic member D to pull the push plate E toward a direction, such that the push plate E can be sliding on the shaft rods B1 through the sliding holes E1. As the stop end E2 is resisted by the stop strip F2 of stop piece F, a resistance force is created to the push plate, such that a tightness and looseness feeling as if pulling a trigger of real gun can be provided, when the stop end E2 is sliding over the stop strip F2.

To further manifest the advancement and practicability of the present invention, it is compared with a conventional application as below:

Shortcomings of a conventional application:

1. A feeling of a real gun cannot be created when pulling the trigger.
2. It is not easy to determine the status before firing and the status after firing.

Advantages of the present invention:

1. A resistance force is formed between the push plate and the stop piece.
2. A feeling of a real gun is created when pulling the trigger.
3. It can enhance a determination of the status of toy gun before firing and after firing.
4. It is provided with the advancement and practicability.
5. It is provided with an industrial competitiveness.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A gear box structure for a toy gun comprising a box, an exterior of which is provided with a plurality of shaft rods and fixing rods, and an interior of which is provided with a trigger assembly; the trigger assembly being connected to an elastic member, the other end of which is connected to a push plate having a plurality of sliding holes and a stop end; the sliding holes being connected with the shaft rods; a stop piece being located next to the push plate and being provided with a plurality of fixing holes and a stop strip; the fixing holes being assembled with the fixing rods and the stop strip being interfered with the stop end, so as to create a resistance force between the push plate and the stop piece, thereby forming a tightness and looseness feeling as if pulling a trigger of real gun, upon pulling the trigger of toy gun to slide the push plate over the stop piece.

2. The gear box structure for a toy gun according to claim 1, wherein the elastic member is further a spring, a connection rod, an elastic rubber, and other device or material having elasticity.

* * * * *